US005145029A

United States Patent [19]

Blasdell, Jr. et al.

[11] Patent Number: 5,145,029

[45] Date of Patent: Sep. 8, 1992

[54] SELF-STORING MAINTENANCE STAND FOR A SCISSOR LIFT AERIAL WORK PLATFORM

[75] Inventors: Donald W. Blasdell, Jr.; Raymond H. Wetzel, both of Waynesboro, Pa.

[73] Assignee: Kidde Industries, Inc., Iselin, N.J.

[21] Appl. No.: 757,539

[22] Filed: Sep. 11, 1991

[51] Int. Cl.[5] ..... E04G 1/22

[52] U.S. Cl. ..... 182/63; 182/141; 182/69; 52/109; 187/18

[58] Field of Search ..... 182/63, 69, 141, 148, 182/127; 52/109; 187/18

[56] References Cited

U.S. PATENT DOCUMENTS

| | | | |
|---|---|---|---|
| 196,679 | 10/1877 | Lane | 182/157 |
| 198,499 | 12/1877 | Pack | 182/69 |
| 942,683 | 12/1909 | Vaghi | 182/157 |
| 2,921,645 | 1/1960 | Morrow | 182/157 |
| 3,596,735 | 8/1971 | Denier | 182/63 |
| 4,068,737 | 1/1978 | Lenz | 182/63 |
| 4,909,357 | 3/1990 | Kawada | 187/18 |

*Primary Examiner*—Reinaldo P. Machado
*Attorney, Agent, or Firm*—Brady, O'Boyle & Gates

[57] ABSTRACT

A self-storing maintenance stand for a scissor lift aerial work platform wherein a pair of arms are freely pivoted on each side of a stack of pivotally connected scissor arms at the medial portion thereof. An arcuate saddle plate is provided on each end of the pair of arms for engaging protruding end portions of the pivot pins of the next adjacent scissor arms. A weight is connected to the end portion of one of the arms so that the arms will freely pivot to a non-working or stored position.

19 Claims, 3 Drawing Sheets

FIG.6
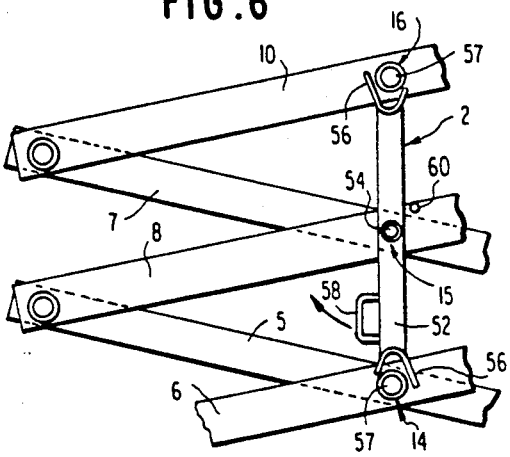
FIG.7
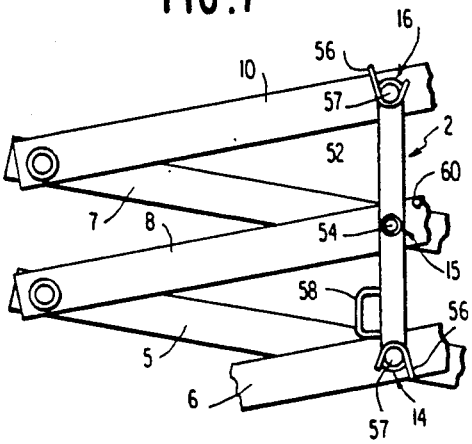
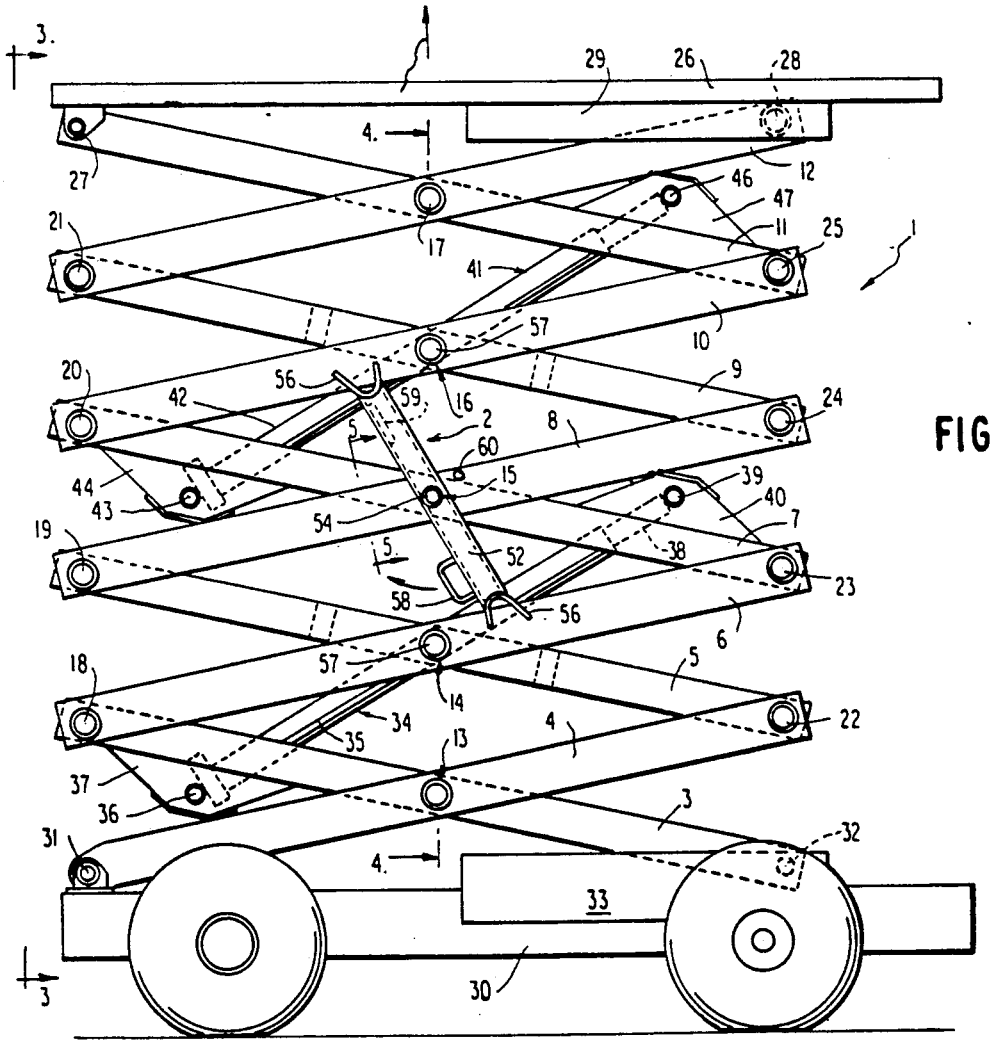
FIG.2

SELF-STORING MAINTENANCE STAND FOR A SCISSOR LIFT AERIAL WORK PLATFORM

BACKGROUND OF THE INVENTION

Blocking devices have been provided for mobile work platform lifts wherein wedges or stop members are provided to hold the platform in the elevated position in the event of failure of the hydraulic lift cylinder or lift cables. Such a blocking device is disclosed in U.S. Pat. No. 4,068,737, dated Jan. 17, 1978.

As far as we are aware there is no blocking device constructed and arranged for use in an aerial work platform having scissor-type lift arms for elevating the platform.

SUMMARY OF THE INVENTION

After considerable research and experimentation, the blocking device or self-storing maintenance stand of the present invention has been devised to hold three sets of adjacently connected aerial work platform scissor arms in an elevated position so that maintenance and service may be performed on the assembly. When in this "working position", the maintenance stand functions as a blocking device for removing the lift loads from the scissor arms and associated lift cylinder, in the event of sudden hydraulic pressure loss, or for removal and replacement of the lift cylinder or cylinders.

The self-storing maintenance stand of the present invention comprises, essentially, a pair of arms freely pivoted on each side of the stack of pivotally connected scissor arms at the medial portion thereof. Each arm of the pair of arms is provided with an arcuate saddle plate on each end thereof adapted to engage, when the scissor arms are extended to an elevated positions, and when the maintenance stand is pivoted to the "working position", the protruding end portions of the pivot pins of the next adjacent extended scissor arms to the top of and to the bottom of the scissor arms to which the maintenance stand is pivotally connected.

Each maintenance stand arm is weighted on one end thereof, whereby, when maintenance on the aerial work platform machine is completed, the lift cylinder or cylinders are extended to lift or extend the scissor arms slightly upwardly from the "working position" of the maintenance stand, the maintenance stand will automatically rotate or freely pivot to the "non-working" or stored position, whereupon the lift cylinder or cylinders are retracted to retract and lower the scissor arms and associated platform to the stored position.

BRIEF DESCRIPTION OF THE DRAWINGS

FIG. 2, is a side elevational view showing the maintenance stand being pivoted to the operative position after the aerial work platform has been moved to an elevated position;

FIG. 6 is a fragmentary side elevational view illustrating the position of the maintenance stand just before the operative position; and FIG. 7 is a fragmentary side elevational view illustrating the position of the maintenance stand in the operative or "working" position.

DESCRIPTION OF THE PREFERRED EMBODIMENT

Figure 1:
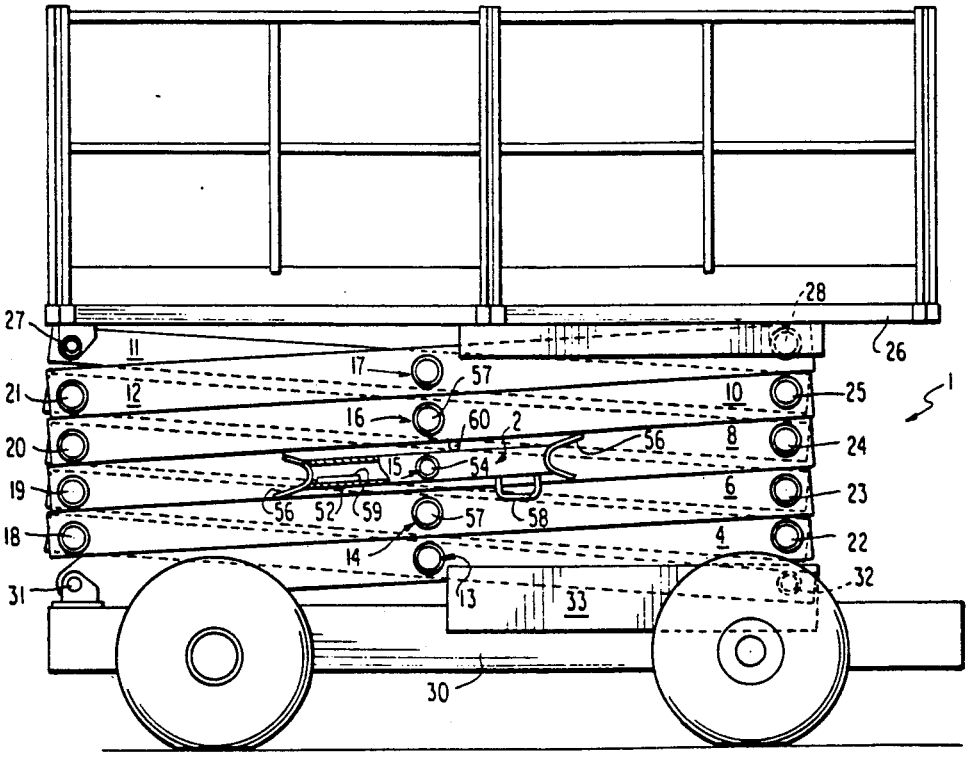
FIG. 1 is a side elevational view, partly in section showing the maintenance stand of the present invention and associated scissor lift aerial work platform in the stored position.

Referring to the drawings in greater detail, and more particularly to FIGS. 1 and 2, the scissor lift aerial work platform 1, on which the self-storing maintenance stand 2 of the present invention is mounted, is a conventional scissor-type lever mechanism and includes at least three sets of scissor-type lever arms; but is illustrated on a machine having five sets of lever arms 3, 4; 5, 6; 7, 8; 9, 10; and 11, 12, pivotally connected at their medial portions as at 13, 14, 15, 16 and 17, respectively. The ends of arms 3 and 6; 5 and 8; 7 and 10; and 9 and 12 are pivotally connected as at 18, 19, 20, and 21, respectively, at one end thereof. The ends of arms 4 and 5; 6 and 7; 8 and 9; and 10 and 11 are pivotally connected as at 22, 23, 24 and 25, at the opposite ends from the first mentioned ends. A work platform 26 is supported on the ends of the uppermost lever arms 11 and 12 and is pivotally connected to the end of arm 11 as at 27 and slidably mounted on the end of arm 12 by a roller 28 connected to the end of the arm 12 and slidably received in a guideway 29 depending from the floor of the work platform, in the know manner. Similarly, in the lowermost lever arms 3 and 4, the end of lever arm 4 is pivotally connected to a mobile support 30 as at 31, and the end of arm 3 is provided with a roller 32 slidable in a guideway 33 provided on the mobile support 30, in the known manner.

To raise and lower the scissor lift aerial work platform 1, a first hydraulic actuator 34 is connected between lever arm 3 and lever arm 7 wherein the cylinder 35 of the hydraulic actuator is pivotally connected as at 36 to a depending bracket 37 welded to the lever arm 3, and the piston rod end 38 of the actuator is pivotally connected as at 39 to an upstanding bracket 40 welded to the lever arm 7. A second hydraulic actuator 41 is connected between lever arm 7 and lever arm 11, wherein the cylinder portion 42 of the actuator is pivotally connected as at 43 to a depending bracket 44 welded to the lever arm 7, and the piston rod end 45 of the actuator is pivotally connected as at 46 to an upstanding bracket 47 welded to the arm 11.

Figure 3:
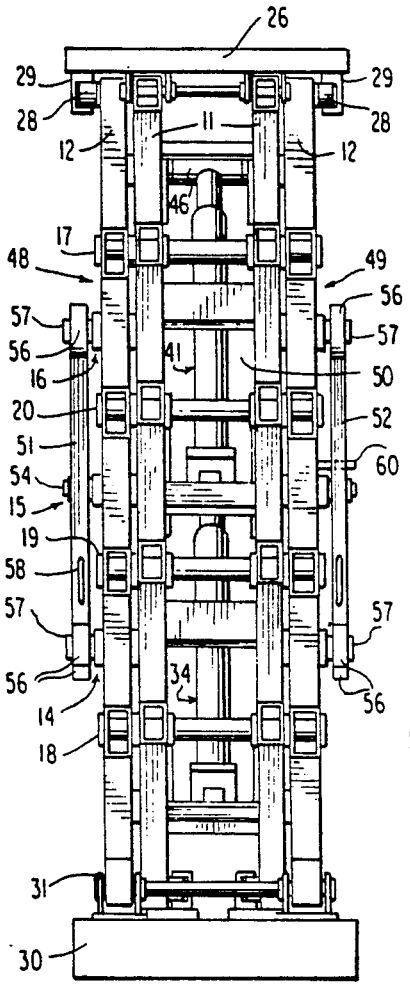
FIG. 3 is a partial end elevational view taken along line 3—3 of FIG. 2.
Figure 4:
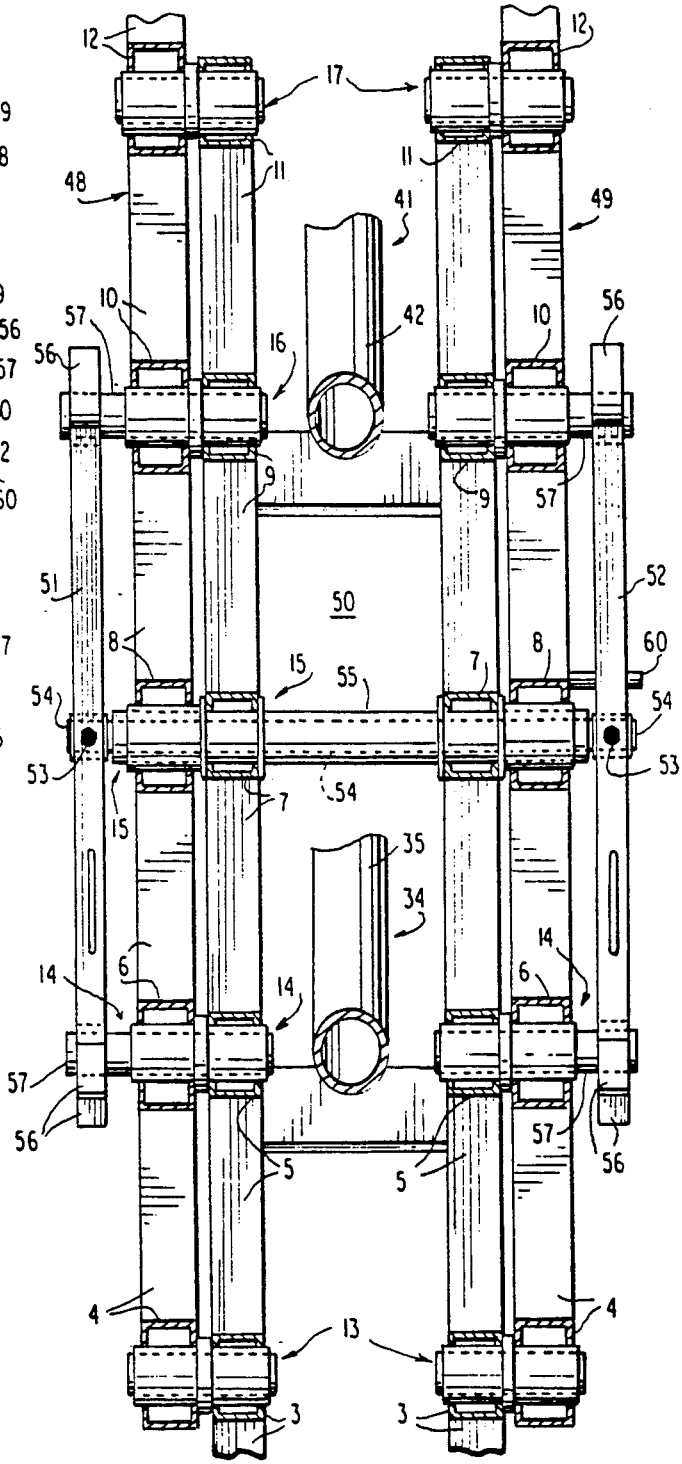
FIG. 4 is a vertical section view taken substantially along line 4—4 of FIG. 2.

While the lever arms have been referred to in the singular, as will be seen in FIGS. 3 and 4, there are a pair 48 and 49 of the five sets of lever arms for supporting the work platform 26 on the support platform 30, the pair of five sets being spaced transversely of the support platform with the hydraulic actuators 34 and 41 being positioned in the space 50 therebetween.

Figure 5:
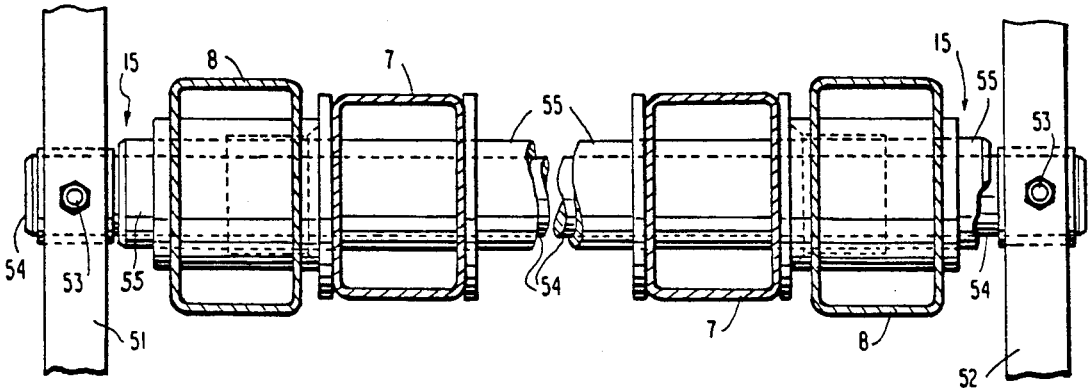
FIG. 5 is an enlarged fragmentary cross-sectional view taken substantially along line 5—5 of FIG. 2.

As will be seen in FIGS. 2, 4 and 5, the self-storing maintenance stand or blocking device 2 of the present invention comprises, a pair of tubular arms 51 and 52 positioned outboard of the pairs 48 and 49 of the three to five or more sets of lever arms. The intermediate portion of each tubular arm 51 and 52 is fastened as at 53 to opposite end portions of a transversely extending shaft 54. The shaft 54 is part of the pivotal connection 15 of scissor lever arms 7 and 8 and forms a pivot pin for a sleeve or bushing 55 through which the shaft 54 extends, the arms 7 and 8 being mounted for pivotal movement relative to each other on the sleeve 55.

Referring to FIGS. 4, 6 and 7, the opposite ends of each tubular arm 51, 52 are provided with arcuate saddle plates 56 into which the extended pin portions 57 of pivotal connections 14 and 16 are adapted to be seated when the tubular arms 51, 52 have been pivoted to the operative position as shown in FIG. 7. A handle 58 is secured to each tubular arm 51 and 52 to facilitate manually pivoting the arms to the operative position, and, as will be seen in FIG. 1, a weight 59 is mounted within tubular arm 52 at one end thereof, whereby when the arms 51, 52 are released from the operative position, they freely pivot counter clockwise to the inoperative or stored position as shown in FIG. 1. To arrest the pivotal movement of the tubular arms 51 and 52 at the stored position, stop pin 60 is secured to the lever arm 8 and extends outwardly therefrom into the path of the arm 52.

In the operation of the maintenance stand 2 of the present invention, after the aerial work platform 26 has been elevated from the stored position, as shown in FIG. 1, to an elevated position, as shown in FIG. 2, the tubular arms 51 and 52 are manually pivoted via handle 58, as a unit, to the operative position, as shown in FIG. 6, so that the extended pin portions 57 of the pivotal connections 14 and 16 can be seated in the arcuate saddle plates 56, as shown in FIG. 7, when the aerial work platform is slightly retracted. By this construction and arrangement, each tubular arm 51, 52 holds three sets of scissor arms in an elevated position, each set of arms being respectively connected at the pivotal connections 14, 15 and 16; namely, scissor arms 5, 6; 7, 8; and 9, 10. Since these sets of scissor arms are connected at their ends to the other scissor arms, because of the scissor mechanism all of the scissor arms are held in an elevated position, as shown in FIG. 3. When in this position, the maintenance stand functions as a blocking device to prevent the scissor arm assembly from collapsing in the event of hydraulic pressure loss in the lift cylinders 34 and 41; and also as a support to hold the platform 26 in the elevated position during the maintenance of the assembly or removal and replacement of the hydraulic lift cylinder 34 and 41.

When it is desired to move the maintenance stand 2 from its "working position" in which it locks the scissor arms in an elevated position, and to lower the scissor arms and the aerial platform 26 to the stored position, or return the aerial work platform to a workable condition, the scissor arms are first slightly extended by the hydraulic cylinder piston assemblies 34, 41 to move the extended pin portions 57 of the pivotal connections 14 and 16 out of the seated engagement with the saddle plates 56. The weight 59 will then cause the tubular arms 51 and 52 to freely pivot in a counter-clockwise direction to the inoperative or stored position and held thereat by stop pin 60, preferably in alignment with scissor arms 8.

It is to be understood that within the scope of this invention the maintenance stand 2 is operable with one pivoting tubular arm 52 as well as with the pair of pivoting tubular arms 51 and 52.

The terms and expression which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

We claim:

1. A maintenance stand for a scissor lift aerial work platform of the type having a work platform supported by a plurality of pairs of scissor lever arms pivotally connected at their medial portions, with adjacent pairs of scissor arms pivotally connected at their end portions, and at least one actuator operatively connected to the scissor lever arms for raising the lever arms and associated platform from a retracted position to an elevated position; said maintenance stand comprising, an arm, a transversely extending shaft connected to a first medial pivot; connection of a first pair of scissor lever arms, said arm being connected to said shaft and being freely rotatable therewith, first and second transversely extending shaft portions respectively connected to the adjacent medial pivot connection of a second pair of scissor lever arms above said first medial pivot connection, and to the adjacent medial pivot connection of a third pair of scissor lever arms below said first medial pivot connection, and a seat mounted on each end of said freely rotatable arm, whereby when the work platform is raised to an elevated position, the arm is rotatable to a substantially vertical position to position the seats for supporting said first and second transversely extending shaft portions on the next adjacent medial pivot connections, to thereby hold the lever arms and associated work platform in an elevated position.

2. A maintenance stand according to claim 1, wherein said seat on each end of the freely rotatable arm comprises an arcuate saddle plate.

3. A maintenance stand according to claim 1, wherein said freely rotatable arm is connected to said shaft at a position intermediate the ends of the arm, and weight means mounted on the arm at one end portion thereof, whereby when the arm is released from the supporting position it freely pivots to a substantially horizontal, stored position, thereby rendering the maintenance stand self-storing.

4. A maintenance stand according to claim 3, including stop means mounted on one of the scissor lever arms in proximity of said first medial pivot connection to thereby provide a stop to arrest the rotation of the freely rotatable arm to its stored position.

5. A maintenance stand according to claim 1, wherein the plurality of pairs of scissor lever arms are mounted on a support platform on each side thereof, said transversely extending shaft connected to said first medial pivot connection extending transversely across said platform and connected to a corresponding first medial pivot connection on the respective side of the support platform, a second arm connected to the end portion of said transversely extending shaft at said corresponding pivot connection, whereby said pair of arms are freely rotatable as a unit between the stored and operative positions.

6. A maintenance stand according to claim 1, including handle means connected to said freely rotatable arm adjacent one end thereof, whereby said arm is manually rotatable to the substantially vertical use position.

7. A maintenance stand according to claim 4, in which said stop means comprises a pin connected at substantially right angle to one of the scissor lever arms of said first pair of scissor lever arms.

8. A maintenance stand according to claim 1, in which said transversely extending shaft is pivotally connected coaxial with said first medial pivot connection.

9. A maintenance stand according to claim 2, in which each saddle plate has a pair of free ends one of which is longer than the other.

10. A maintenance stand according to claim 2, in which the longer end of each saddle plate comprises a stop member adapted to contact the respective first or second transversely extending shaft portion to position said saddle plate in alignment therewith.

11. A maintenance stand for a scissor lift aerial work platform of the type having a work platform supported by plural pairs of scissor lever arms pivotally connected at their medial portions, with adjacent pairs of scissor arms pivotally connected at their end portions, and at least one actuator operatively connected to the scissor lever arms for raising the lever arms and associated platform from a retracted position to an elevated position; said maintenance stand comprising, an arm pivotally connected for rotative movement to a medial pivot connection of a first pair of scissor lever arms, a transversely extending shaft portion respectively connected to the medial pivot connection of an adjacent second pair of scissor lever arms, and a seat mounted on one end of said rotatable arm, whereby when the work platform is raised to an elevated position, the arm is rotatable to a substantially vertical position to position said seat for engaging and supporting said transversely extending shaft portion on the adjacent medial pivot connection, to thereby hold the lever arms and associated work platform in an elevated position.

12. A maintenance stand according to claim 11, wherein said seat on one end of the rotatable arm comprises an arcuate saddle plate.

13. A maintenance stand according to claim 11, including a transversely extending shaft connected to said medial pivot connection of said first pair of scissor lever arms, and said arm connected to said transversely extending shaft and being rotatable therewith.

14. A maintenance stand according to claim 11, including stop means mounted on one of the scissor lever arms in proximity to said medial pivot connection of said first pair of scissor lever arms to thereby provide a stop to hold the rotatable arm in a stored position.

15. A maintenance stand according to claim 11, including handle means connected to said rotatable arm between said pivotal connection and said seat, whereby said arm is manually rotatable to the substantially vertical use position.

16. A maintenance stand for a scissor lift aerial work platform machine of the type having a work platform supported by plural pairs of scissor lever arms mounted on a support platform and pivotally connected at their medial portions, with adjacent pairs of scissor arms pivotally connected at their end portions, and at least one actuator operatively connected to the scissor lever arms for raising the lever arms and associated platform from a retracted position on the support platform to an elevated position; said maintenance stand comprising, an arm pivotally connected for rotative movement to a medial pivot connection of a first pair of scissor lever arms, and a seat mounted on one end of said rotatable arm, whereby when the work platform is raised to an elevated position, the arm is rotatable to a substantially vertical position to engage said seat with an adjacent portion of said aerial work platform machine, to thereby hold the lever arms and associated work platform in an elevated position.

17. A maintenance stand according to claim 16, including a transversely extending shaft connected to said medial pivot connection of said first pair of scissor lever arms, and said arm connected to said transversely extending shaft and being rotatable therewith.

18. A maintenance stand according to claim 16, including stop means mounted on one of the scissor lever arms in proximity to said medial pivot connection of said first pair of scissor lever arms to thereby provide a stop to hold the rotatable arm in a stored position.

19. A maintenance stand according to claim 16, including handle means connected to said rotatable arm between said pivotal connection and said seat, whereby said arm is manually rotatable to the substantially vertical use position.

* * * * *